US010008344B2

(12) United States Patent
Lin et al.

(10) Patent No.: US 10,008,344 B2
(45) Date of Patent: Jun. 26, 2018

(54) SWITCH ASSEMBLY AND HAND-HELD DEVICE

(71) Applicant: HTC Corporation, Taoyuan (TW)

(72) Inventors: Yu-Yu Lin, Taoyuan (TW); Hung-Chi Shui, Taoyuan (TW); Jen-Tsung Chang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days. days.

(21) Appl. No.: 14/937,885

(22) Filed: Nov. 11, 2015

(65) Prior Publication Data

US 2017/0133175 A1 May 11, 2017

(51) Int. Cl.
*H01H 13/70* (2006.01)
*H01H 13/14* (2006.01)
(Continued)

(52) U.S. Cl.
CPC ..... *H01H 13/14* (2013.01); *H01H 13/08* (2013.01); *H01H 15/22* (2013.01);
(Continued)

(58) Field of Classification Search
CPC .... H01H 13/14; H01H 13/08; H01H 2223/04; H01H 15/22; H01H 2239/066;
(Continued)

(56) References Cited

U.S. PATENT DOCUMENTS 7,288,735 B2 * 10/2007 Naijo ..... H01H 13/702 200/341
8,859,920 B2 10/2014 Manullang et al.
(Continued)

FOREIGN PATENT DOCUMENTS

CN 100434131 11/2008
CN 201853615 6/2011
(Continued)

OTHER PUBLICATIONS

"Notice of Allowance of Taiwan Counterpart Application", dated Jun. 29, 2016, p. 1-p. 5.
(Continued)

*Primary Examiner* — Edwin A. Leon
*Assistant Examiner* — Lheiren Mae A Caroc
(74) *Attorney, Agent, or Firm* — JCIPRNET

(57) ABSTRACT

A switch assembly is adapted to be disposed in a holding portion of a hand-held device. The switch assembly includes first and second keys, first and second connecting portions, a switch element and a plunger. The first and second keys are exposed on the surface of the holding portion and respectively disposed on the opposite sides thereof. The first and second connecting portions respectively connect the first and second keys and the holding portion. The first and second connecting portions are disposed for allowing the first key having a displacement toward the second key along their connecting direction. The switch element is located inside of the holding portion, and the first key has a first backside toward the second key. The second key has a second backside toward the first key. The plunger is adapted to press and activate the switch element through the displacement.

11 Claims, 3 Drawing Sheets

(51) Int. Cl.
*H01H 13/08* (2006.01)
*H01H 15/22* (2006.01)

(52) U.S. Cl.
CPC . *H01H 2217/002* (2013.01); *H01H 2221/044* (2013.01); *H01H 2223/04* (2013.01); *H01H 2227/034* (2013.01); *H01H 2239/066* (2013.01)

(58) Field of Classification Search
CPC ..... H01H 2227/034; H01H 2221/044; H01H 2217/002
USPC ..... 200/341, 344, 345, 504, 505
See application file for complete search history.

(56) References Cited

U.S. PATENT DOCUMENTS

| | | | | |
|---|---|---|---|---|
| 2001/0047927 | A1* | 12/2001 | Ogawa | H01H 13/70 200/343 |
| 2010/0253230 | A1* | 10/2010 | Foreman | H01H 9/0228 315/153 |
| 2014/0311880 | A1* | 10/2014 | Krumpelman | H01H 13/14 200/5 A |
| 2015/0144470 | A1 | 5/2015 | Chang | |

FOREIGN PATENT DOCUMENTS

| | | |
|---|---|---|
| CN | 102194596 | 9/2011 |
| DE | 102006036143 | 2/2008 |
| JP | S54182869 | 12/1979 |
| JP | H06208818 | 7/1994 |
| JP | H09140947 | 6/1997 |
| JP | 2010044865 | 2/2010 |
| SU | 1686519 | 10/1991 |
| TW | M385226 | 8/2010 |

OTHER PUBLICATIONS

"Search Report of Europe Counterpart Application", dated Apr. 4, 2017, p. 1-p. 5.

"Office Action of European Counterpart Application," dated May 3, 2017, p. 1-p. 7.

"Office Action of China Counterpart Application," dated Feb. 27, 2018, p. 1-p. 9.

* cited by examiner

SWITCH ASSEMBLY AND HAND-HELD DEVICE

BACKGROUND OF THE DISCLOSURE

1. Field of the Disclosure

The disclosure relates to a switch assembly, and more particularly to a switch assembly for a hand-held device.

2. Description of Related Art

In the design of a general switch assembly, each key corresponds to a switch or a metal dome connected to a circuit board. Thus, each of the switches or metal domes of the switch assembly is independent. Therefore, whenever bad key feeling occurs, analysis and adjustment must be done individually to each key. In addition, since each key corresponds to a switch or a metal dome, configuration of conventional keys and switches often have problems of tolerance stroke being too long, causing difficulties in adjusting the key feeling efficiently and accurately. Furthermore, general configuration of conventional keys and switches may also make the configuration number of the switch elements cannot be effectively reduced, causing the increase in the production cost of the overall switch assembly and the hand-held device.

SUMMARY OF THE DISCLOSURE

The disclosure provides a switch assembly, capable of reducing the assembling tolerance, effectively improving the key feeling and reducing the production cost of the overall assembly.

The disclosure provides a hand-held device, through the configuration of the switch assembly thereof, capable of reducing the number of required switch elements for assembling and thereby reducing the production cost of the overall hand-held device.

The switch assembly of the disclosure is adapted to be disposed in a holding portion of the hand-held device. The switch assembly includes a first key, a second key, a first connecting portion, a second connecting portion, a switch element and a plunger. The first and second keys are exposed on the surface of the holding portion, and the first and second keys are respectively located on two opposite sides of the holding portion. The first connecting portion connects the first key and the holding portion. The second connecting portion connects the second key and the holding portion. The first and second connecting portions are disposed for allowing the first key generating a displacement with respect to the second key along the connecting direction of the first key and the second key. The switch element is located within the holding portion. The first key has a first backside toward the second key. The switch element is disposed on the first backside. The plunger is located within the holding portion. The second key has a second backside toward the first key. The plunger is disposed on the second backside, and the plunger is adapted to press the switch element, and activate the switch element through the displacement.

The hand-held device of the disclosure includes the holding portion and the abovementioned switch assembly.

In light of the above, the switch assembly of the disclosure is adapted for the hand-held device and has the first key and the second key. In addition, the switch element is disposed on the first backside of the first key, and the plunger is disposed on the second backside of the second key. The first key generates displacement with respect to the second key along their connecting direction. Moreover, through the displacement of the first key, the plunger may press the switch element and further activates the switch element.

Therefore, the first key and the second key may be disposed to correspond to the same switch element, without having to configure individual corresponding switch element to be in one-to-one configuration. Thus, the cost of materials and assembling process of the switch assembly and the hand-held device may effectively be reduced, and the accumulation of the assembling tolerance between keys and the switch elements may also be reduced, thereby increasing the sensitivity and key feeling of the keys.

To make the above features and advantages of the disclosure more comprehensible, several embodiments accompanied with drawings are described in detail as follows.

DESCRIPTION OF THE EMBODIMENTS

Figure 1:
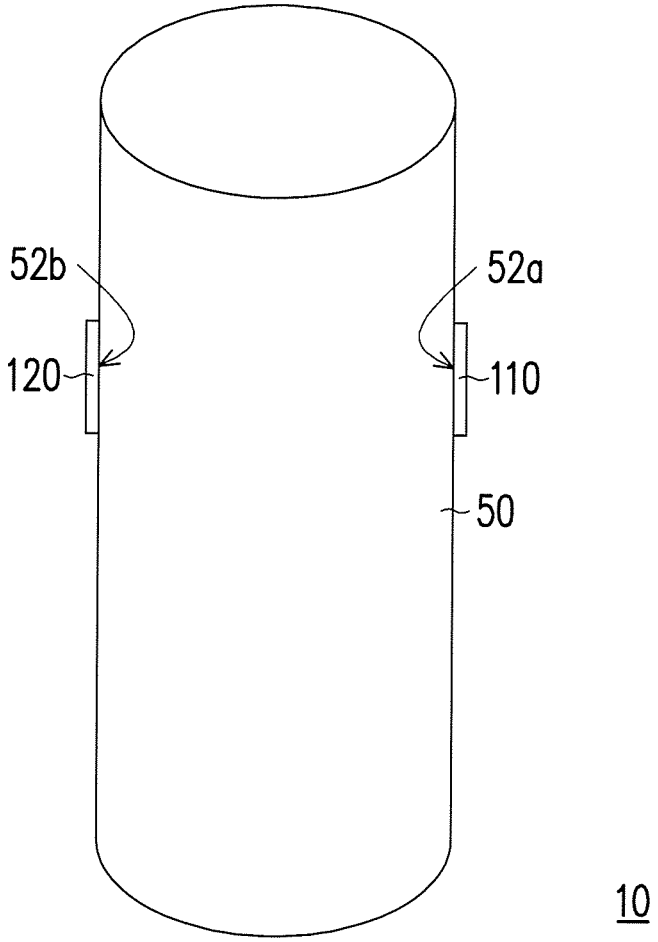
FIG. 1 is a schematic view illustrating a hand-held device according to an exemplary embodiment of the invention.
Figure 2:
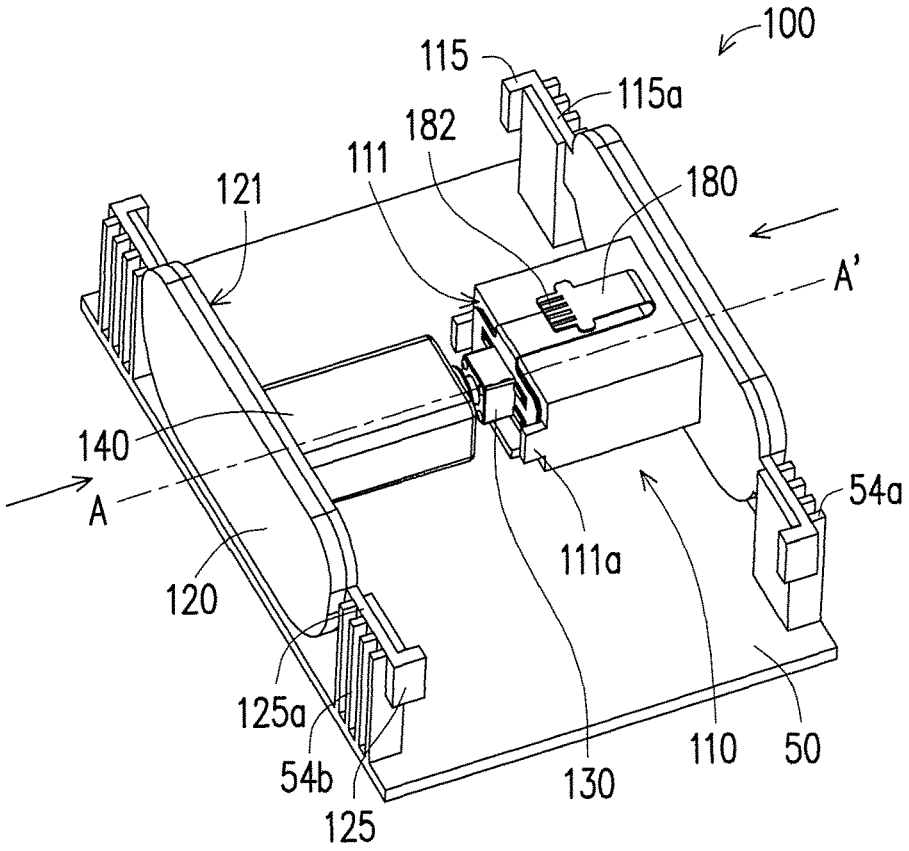
FIG. 2 is a schematic view illustrating a switch assembly according to an exemplary embodiment of the invention.

FIG. 1 is a schematic view illustrating a hand-held device according to an exemplary embodiment of the invention. FIG. 2 is a schematic view illustrating a switch assembly according to an exemplary embodiment of the invention. Referring to FIG. 1, the switch assembly 100 may be disposed in the holding portion 50 of a hand-held device 10, and the switch assembly 100 includes a first key 110 and a second key 120. In addition, the two opposite sides of the holding portion 50 have a first opening 52*a* and a second opening 52*b*, respectively, so as to respectively expose the first key 110 and the second key 120 on the surface of the holding portion 50. Moreover, as shown in FIG. 2, the switch element 100 includes a first connecting portion 115 connected between the first key 110 and the holding portion 50 and a second connecting portion 125 connected between the second key 120 and the holding portion 50. In the present embodiment, the holding portion 50 may have a first position limiting portion 54*a* and a second position limiting portion 54*b*, and the first and second position limiting portions 54*a* and 54*b* are disposed to respectively correspond to the first key 110 and the second key 120. In addition, the first connecting portion 115 and the second connecting portion 125 are clamped in the first position limiting portion 54*a* and the second position limiting portion 54*b*, respectively.

In the present embodiment, the hand-held device 10 may be a game handle, an imaging device, a communication device, a wearable device, and the like, the type and sort of the hand-held device are not limited in the disclosure.

In addition, the first connecting portion 115 and second connecting portion 125 of the embodiment are disposed for allowing the first key 110 generating a displacement with respect to the second key 120 along the connecting direction AA' of the first key 110 and the second key 120. Therefore, as shown in FIG. 2, the first key 110 may be pressed by the user along the direction of the arrow which is near the first key 110. In detailed, the first connecting portion 115 may include two bendable first elastic arms 115*a* which are connected between the first key 110 and the first position limiting portion 54*a* of the holding portion 50. Therefore, when the user presses the first key 110, the first connecting portion 115 may drive the first key 110 to generate a displacement toward the second key 120 along the connecting direction AA' with respect to the holding portion 50 due to the flexibility of the first elastic arms 115*a*.

In addition, the second connecting portion 125 may also include two bendable second elastic aims 125*a* which are connected between the second key 120 and the second position limiting portion 54*b* of the holding portion 50. When the user presses the second key 120 along the direction of the arrow near the second key 120, the second connecting portion 125 may also drive the second key 120 to generate a displacement toward the first key 110 along the connecting direction AA' with respect to the holding portion 50 due to the flexibility of the second elastic aims 125*a*. In the present embodiment, the first connecting portion 115 and the first key 110 may be integrally formed, and the second connecting portion 125 and the second key 120 may be integrally formed.

Figure 3:
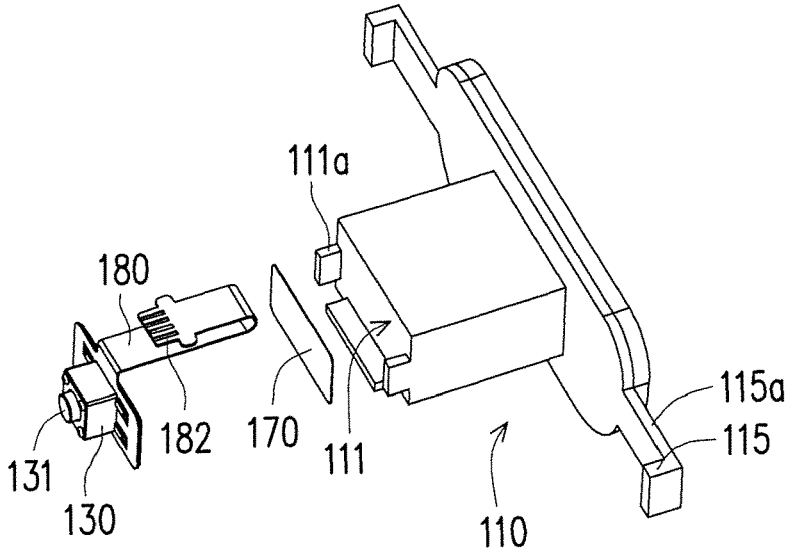
FIG. 3 is a schematic view illustrating some components of the switch assembly of FIG. 2.

FIG. 3 is a schematic view illustrating some components of the switch assembly of FIG. 2. Referring to FIG. 1, FIG. 2 and FIG. 3, the first key 110 has a first backside 111 toward the second key 120. In addition, the switch assembly 100 may have a switch element 130. The switch element 130 is disposed within the holding portion 50 of the hand-held device 10, and located on the first backside 111 of the first key 110. As shown in FIG. 3, the switch element 130 may include an activating end 131. In the present embodiment, the activating end 131 of the switch element 130 may have a switch button. Additionally, the switch assembly 100 may have a flexible printed circuit (FPC) 180, and the flexible printed circuit 180 is electrically coupled to the switch element 130. For example, the switch element 130 may be connected to the flexible printed circuit 180 by a wire bonding method or a wire jumper method.

In addition, referring to FIG. 2, the second key 120 has a second backside 121 toward the first key 110, while the switch assembly 100 has a plunger 140, and the plunger 140 is disposed on the second backside 121 of the second key 120. In the present embodiment, the plunger 140 may press the activating end 131 of the switch element 130 via the displacement of the first key 110 or the second key 120 with respect to the holding portion 50, thereby further activating the switch element 130.

The switch element 130 and the flexible printed circuit 180 may be attached to the first backside 111 by using an adhesive tape 170 or other adhering method. In the present embodiment, the first key 110 may have a plurality of position limiting protruding ribs 111*a* (only three of them are shown in FIG. 2 and FIG. 3 as an example) on the first backside 111 thereof. The position limiting protruding ribs 111*a* on the first backside 111 may serve as the alignment reference when the adhesive tape 170, the switch element 130 and the flexible printed circuit 180 are adhered. Thus, the switch element 130 and the flexible printed circuit 180 may be adhered onto the first backside 111 at suitable positions, such that the switch element 130 may accurately receive the pressing of the plunger 140. In addition, the flexible printed circuit 180 has a plurality of connecting terminals 182, and the connecting terminals 182 are available to electrically couple other external components. Thus, the switch element 130 may be electrically coupled to other external devices or components via the flexible printed circuit 180.

In the design of the switch assembly 100 of the embodiment, the two first elastic arms 115*a* of the first connecting portion 115 of the switch assembly 100 may be composed of the material having the same elastic coefficient. However, the two first elastic arms 115*a* may also be composed of material having different elastic coefficients, such that the degrees of flexibility between the two first elastic arms 115*a* may be different. In other words, under the condition that the two first elastic arms 115*a* of the first connecting portion 115 have the same dimension, when subjected to the force with the same direction and magnitude, the degrees of deflection of the two first elastic arms 115*a* are different. Briefly, the sensitivity and key feeling of the first key 110 may be adjusted by adjusting the elastic coefficients of the two first elastic arms 115*a*.

In addition, the two second elastic aims 125*a* of the second connecting portion 125 may be composed of the material having the same elastic coefficient. However, the two second elastic arms 125*a* may also be composed of material having different elastic coefficients, such that the degrees of flexibility between the two second elastic aims 125*a* may be different. In other words, under the condition that the two second elastic arms 125*a* of the second connecting portion 125 have the same dimension, when subjected to the force with the same direction and magnitude, the degrees of deflection of the two second elastic arms 125*a* are different. Briefly, the sensitivity and key feeling of the second key 120 may be adjusted by adjusting the elastic coefficients of the two second elastic arms 125*a*.

In the present embodiment, the degrees of flexibility of the first elastic arms 115*a* and the second elastic arms 125*a* may also be different or the same. In addition, since the first connecting portion 115 and the second connecting portion 125 respectively have bendable first elastic arms 115*a* and second elastic arms 125*a*, such that the first key 110 and the second key 120 may generate a displacement relative to the holding portion 50 at the same time while the user presses thereon, thereby the switch element 130 may be activated due to the pressing of the plunger 140.

As such structure design mentioned above, the first key 110 and the second key 120 of the switch assembly 100 may share the same switch element 130. In other words, in the present embodiment, one-to-one configuration is not required between the first key 110, the second key 120 and the switch element 130. Therefore, the number of switch elements 130 may be reduced in the structure of the switch assembly 100, and thereby the manufacturing cost of the overall switch assembly 100 is reduced. Furthermore, in the present embodiment, the first key 110 and the second key 120 are disposed to correspond to the same single switch element 130. Therefore, compared to the conventional configuration that the keys and the switch elements are in one-to-one configuration, the accumulation of assembling tolerance between the first and second keys 110 and 120 and the switch element 130 may effectively be reduced, thereby facilitating that the sensitivity and key feeling of the first and second keys 110 and 120 may more accurately be adjusted.

For example, if the hand-held device 10 is a game handle, the user is able to use his/her left hand or right hand to hold the first key 110 and the second key 120 of the hand-held device 10, without having to consider the position of the thumb of the left hand or right hand. No matter pressing the first key 110 or the second key 120, both may trigger the switch element 130 so as to output a control signal. Thus, the user may operate the hand-held device 10 with left hand or right hand. In addition, the user may output a control signal as long as holding the first key 110 and the second key 120 with force, without having to consider the position of the thumb.

Figure 4:
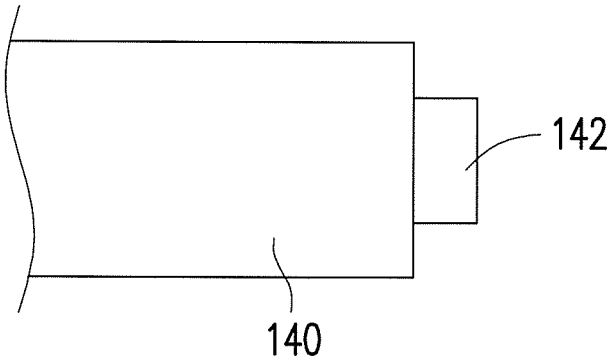
FIG. 4 is a schematic side view illustrating some components of the switch assembly of FIG. 2.

FIG. 4 is a schematic side view illustrating some components of the switch assembly of FIG. 2. Referring to FIG. 3 and FIG. 4, at the front end of the plunger 140, i.e., at the end of the plunger 140 toward the switch element 130, a protruding block 142 may be disposed. In the present embodiment, the protruding block 142 may be disposed in alignment with the activating end 131 of the switch element 130, so as to adjust the distance between the plunger 140 and the switch element 130. In detailed, when the front end of the plunger 140 presses the switch element 130, the distance between the plunger 140 and the switch element 130, probably due to tolerance being too large, or the plunger 140 and the switch element 130 being not adjusted to be in suitable relative positions, may cause the switch element 130 unable to actually be pressed, and resulting in poor pressing sensitivity of the first key 110 and the second key 120. Therefore, in the present embodiment, the protruding block 142 of the switch element 130 is disposed at the front end of the plunger 140, such that when the user presses the first key 110 or the second key 120, the protruding block 142 may accurately press the activating end 131 of the switch element 130. Thus, the sensitivity and the key feeling of the first key 110 and the second key 120 may be improved.

Figure 5:
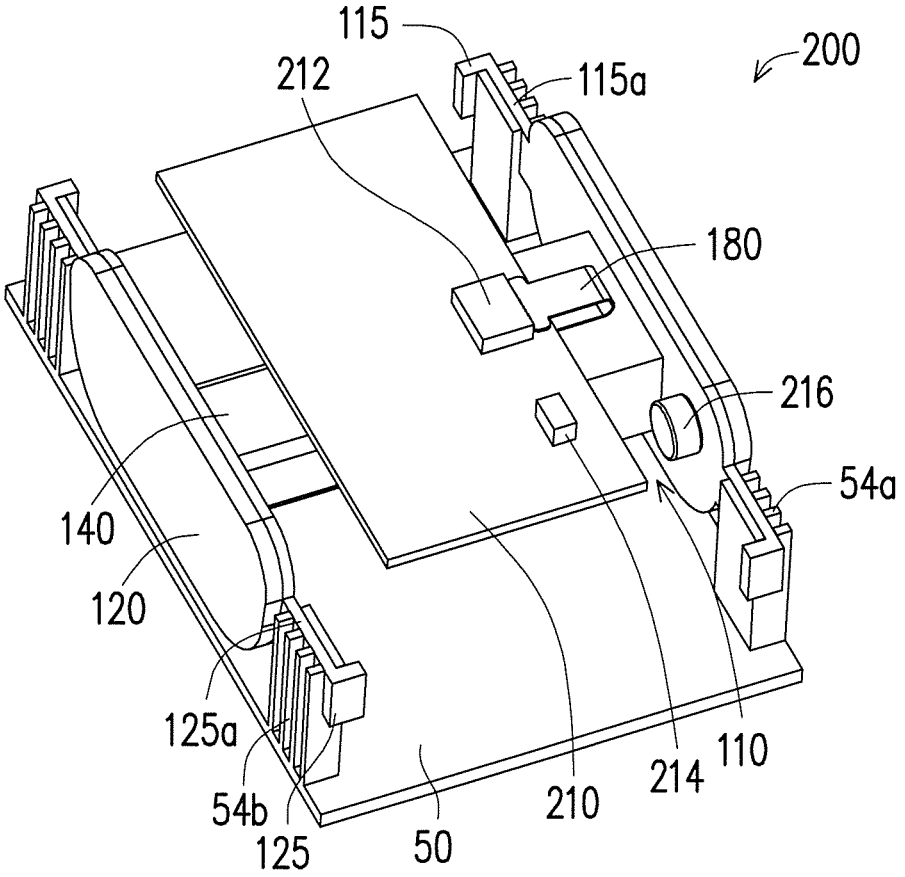
FIG. 5 is a schematic view illustrating a switch assembly according to another exemplary embodiment of the invention.

FIG. 5 is a schematic view illustrating a switch assembly according to another exemplary embodiment of the invention. The embodiment of FIG. 5 has the structure similar to the embodiment of FIG. 1, thus the same of similar components are represented by the same or similar symbols, and are not repeated herein. In the present embodiment, the switch assembly 200 further includes, besides the components included in the switch assembly 100, a printed circuit board 210 and a sensing element 214. The printed circuit board 210 has a connector 212, and the connector 212 may receive the connecting terminals 182 of the flexible printed circuit 180, so that the printed circuit board 210 and the flexible printed circuit 180 are electrically connected with the switch element 130.

In addition, the sensing element 214 is disposed on the printed circuit board 210 and adjacent to the first key 110. The sensing element 214 is, for example, a magnetic force sensor, and on the first key 110, a magnet 216 corresponding to the sensing element 214 may be disposed. More specifically, in the present embodiment, the magnetic force sensor which serves as the sensing element 214 may be a hall effect sensor. In the present embodiment, the magnet 216 is only disposed on the first key 110. Thus, the sensing element 214 may define the displacement of the first key 110 by detecting the variation of the distance between the sensing element 214 and the magnet 216. Simultaneously, since no magnet is disposed on the second key 120, the sensing element 214 may not detect the displacement of the second key 120. And therefore, the present embodiment may detect the displacement of the first key 110 by the configuration of the sensing element 214 and the magnet 216 and differentiate whether the activation of the switch element 130 is due to the displacement of the first key 110 or the second key 120.

Accordingly, since the switch assembly 200 may distinguish the displacement of the first key 110 and the second key 120 via the sensing element 214 and the magnet 216, the first key 110 and the second key 120 of the switch assembly 200 may respectively correspond to different functions. And therefore, when the user presses the first key 110 and the second key 120 of the hand-held device 10, different functions and effects may be generated, respectively.

For example, when the switch element 130 is activated because subjected to the pressing of the plunger 140 and the sensing element 214 detects the displacement of the first key 110, the hand-held device 10 may determine that the activation of the switch element 130 is caused by the displacement of the first key 110. Therefore, the hand-held device 10 may activate the corresponding function related to the first key 110. Relatively, when the switch element 130 is activated because subjected to the pressing of the plunger 140 and the sensing element 214 does not detect the displacement of the first key 110, the hand-held device 10 may determine that the activation of the switch element 130 is caused by the displacement of the second key 120. Therefore, the hand-held device 10 may activate the corresponding function related to the second key 120. In the present embodiment, the first key 110 and the second key 120 may be disposed to correspond to the same single switch element 130, and still remain their corresponding different functions. And thus, the configuration number of the switch elements 130 of the switch assembly 200 of the embodiment may be reduced, and the costs for assembling and manufacturing the overall switch assembly 200 and the hand-held device 10 may also be reduced.

In addition, in other embodiments not shown in the drawings of the disclosure, a sensing element for detecting the displacement of the second key 120 may also be disposed on the printed circuit board 210, and a corresponding magnet may be disposed on the second key 120, such that the displacement of the second key 120 may further be detected and defined.

In light of the foregoing, the switch assembly may be disposed in the holding portion of the hand-held device of the disclosure, and the switch assembly includes the first key and the second key. The first key and the second key are disposed to correspond to the same single switch element. Thus, one-to-one configuration is not required in the keys and the switch element of the switch assembly of the disclosure. Therefore, the number of switch elements may be reduced in the structure of the switch assembly, and thereby the manufacturing cost of the overall switch assembly and the hand-held device is reduced. In addition, in the switch assembly of the disclosure, since two keys correspond to the same single switch element at the same time, the accumulation of the tolerance during the assembling process of the keys and the switch element may effectively be reduced, thereby facilitating that the key feeling of the keys is more accurately adjusted. Furthermore, through the configuration of sensing element and the magnet, the switch assembly may detect the displacement of the first key so as to distinguish the pressing of the first key and the second key, such that the first key and the second key may respectively correspond to different functions.

Although the disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. A switch assembly, adapted to be disposed in a holding portion of a hand-held device, the switch assembly comprising:

a first key, exposed on a surface of the holding portion;

a second key, exposed on the surface of the holding portion, and the first key and the second key respectively located on two opposite sides of the holding portion;

a first connecting portion, connecting the first key and the holding portion, wherein the first connecting portion comprises two first elastic arms which are respectively connected between the first key and the holding portion;

a second connecting portion, connecting the second key and the holding portion, wherein the second connecting portion comprises two second elastic arms which are respectively connected between the second key and the holding portion, wherein the first connecting portion and the second connecting portion are disposed for allowing the first key generating a displacement with respect to the second key along a connecting direction of the first key and the second key;

a switch element, located within the holding portion, wherein the first key has a first backside toward the second key, and the switch element is disposed on the first backside; and a plunger, located within the holding portion, wherein the second key has a second backside toward the first key, and the plunger is disposed on the second backside, the plunger is configured to press the switch element and activate the switch element through the displacement, wherein the holding portion has a first position limiting portion and a second position limiting portion, and the first connecting portion and the second connecting portion are clamped in the first position limiting portion and the second position limiting portion, respectively.

2. The switch assembly as claimed in claim 1, wherein both the first key and the second key are adapted to move with respect to the holding portion.

3. The switch assembly as claimed in claim 1, wherein the two first elastic arms have different elastic coefficients.

4. The switch assembly as claimed in claim 1, wherein the two second elastic arms have different elastic coefficients.

5. The switch assembly as claimed in claim 1, further comprising a sensing element adjacent to the first key and used for detecting the displacement of the first key.

6. The switch assembly as claimed in claim 5, wherein the sensing element comprises a magnetic force sensor, and the first key has a magnet corresponding to the magnetic force sensor.

7. The switch assembly as claimed in claim 6, further comprising a printed circuit board, wherein the magnetic force sensor is disposed on the printed circuit board.

8. The switch assembly as claimed in claim 7, further comprising a flexible printed circuit connected between the switch element and the printed circuit board.

9. The switch assembly as claimed in claim 1, wherein a front end of the plunger has a protruding block, and the protruding block is aligned to an activating end of the switch element.

10. A hand-held device, comprising:

a holding portion; and the switch assembly as claimed in claim 1.

11. The hand-held device as claimed in claim 10, wherein the two opposite sides of the holding portion have a first opening and a second opening, respectively, and the first opening and the second opening expose the first key and the second key, respectively.

* * * * *